US006090445A

United States Patent [19]

Anderson

[11] Patent Number: 6,090,445

[45] Date of Patent: Jul. 18, 2000

[54] METHOD OF DIGITAL PRINTING

[76] Inventor: Dean Robert Gary Anderson, 1741 N. High Country Dr., Orem, Utah 84097

[21] Appl. No.: 09/244,362

[22] Filed: Feb. 4, 1999

Related U.S. Application Data

[62] Division of application No. 08/958,292, Oct. 27, 1997, Pat. No. 5,944,893, which is a continuation of application No. 08/878,650, Jun. 19, 1997, Pat. No. 5,972,111.

[51] Int. Cl.[7] ..... B05D 1/28

[52] U.S. Cl. ..... 427/256; 427/261; 427/348; 101/492

[58] Field of Search ..... 427/256, 273, 427/348, 466, 197, 261; 101/492; 347/3, 21

[56] References Cited

U.S. PATENT DOCUMENTS

| | | |
|---|---|---|
| 1,277,632 | 9/1918 | Mizener . |
| 2,248,713 | 7/1941 | Locke . |
| 2,346,186 | 4/1944 | Poesl . |
| 3,082,119 | 3/1963 | Harris . |
| 3,779,206 | 12/1973 | Sato et al. . |
| 3,805,737 | 4/1974 | Miller et al. . |
| 3,977,842 | 8/1976 | Mayhew . |
| 4,128,668 | 12/1978 | Ernest . |
| 4,294,408 | 10/1981 | Snyder et al. . |
| 4,314,263 | 2/1982 | Carley . |
| 4,324,366 | 4/1982 | Geier et al. . |
| 4,387,124 | 6/1983 | Pipkin . |
| 4,489,758 | 12/1984 | Malarz et al. . |
| 4,527,712 | 7/1985 | Cobbs, Jr. et al. . |
| 4,528,935 | 7/1985 | Patil et al. . |
| 4,585,148 | 4/1986 | Ito . |
| 4,590,857 | 5/1986 | Dahlgren . |
| 4,648,267 | 3/1987 | Seegmiller . |
| 4,720,801 | 1/1988 | Boll . |
| 4,723,712 | 2/1988 | Egli et al. . |
| 4,731,621 | 3/1988 | Hayamizu et al. . |
| 4,750,009 | 6/1988 | Yoshimura . |
| 4,764,780 | 8/1988 | Yamamori et al. . |
| 4,778,642 | 10/1988 | Lee et al. . |
| 4,913,050 | 4/1990 | Beaver et al. . |
| 4,957,782 | 9/1990 | Medler et al. . |
| 5,017,407 | 5/1991 | Robertson . |
| 5,076,767 | 12/1991 | Desaulniers et al. . |
| 5,077,653 | 12/1991 | Barlet . |
| 5,121,143 | 6/1992 | Hayamizu . |
| 5,389,148 | 2/1995 | Matsuraga . |
| 5,511,695 | 4/1996 | Chia et al. . |
| 5,598,973 | 2/1997 | Weston . |

OTHER PUBLICATIONS

NUR Advanced Technologies advertisement for Blueboard™ in *Digital Graphics Magazine,* May/Jun. 1997, p. 69.

Paasche AB (Fine Art) Airbrush instructions, reprinted courtesy of *Airbrush Digest,* 1983.

*Primary Examiner*—Fred J. Parker

*Attorney, Agent, or Firm*—Morris, Bateman, O'Bryant & Compagni

[57] ABSTRACT

A method of digital printing in which paint is deposited in metered amounts on a print medium includes providing a paint injector which advances a paint coated strand through the path of a fluid stream. The fluid stream removes the paint from the exterior of the strand and deposits the paint onto the surface of a print medium. The advancement of the strand is selectively controlled to effectively meter the paint applied to the print medium and the position of the paint injector is controlled relative to the print medium to form an image thereon. The paint injector is comprised of a wheel rotatable by a shaft of a motor, an idler at least partially disposed in paint contained in a reservoir, and a wire disposed at least partially around the wheel and the idler.

26 Claims, 7 Drawing Sheets

METHOD OF DIGITAL PRINTING

This application is a divisional of application Ser. No. 08/958,292, filed Oct. 27, 1997 now U.S. Pat. No. 5,944, 893, which is a continuation-in-part of U.S. patent application Ser. No. 08/878,650 now U.S. Pat. No. 5,972,111.

BACKGROUND

1. Field of the Invention

This invention relates generally to an apparatus used for digital painting or printing and, more specifically, to an apparatus that employs a metering device for metering a quantity of paint to be deposited on a surface to be painted or printed and that deposits the metered quantity of paint or other pigmented liquid material on the surface.

2. Background of the Invention

As computer technology has advanced, the ability to view high resolution graphics on a computer monitor or other visual display device has improved, and the capacity to reproduce these high resolution graphics onto a tangible medium has improved in both resolution, quality, and speed. One of the more significant and lucrative color printer technologies to be developed in recent years is the ink jet printer, which mixes several colors, typically cyan, magenta, yellow and black, on the print medium (e.g., paper) to form a color image. Conventional ink jet printing heads include a plurality of nozzles and thermal elements. Ink is expelled from the nozzles in a jet by bubble pressure created by heating the ink with the thermal elements while the nozzles and thermal elements are in close proximity. One such ink jet printing head, as described in U.S. Pat. No. 5,121,143 to Hayamizu, includes a thermal head member having at least one thermal element consisting of a plurality of thermal dot elements and a plurality of electrodes of different widths connected to each thermal element whereby different widths of heated portions of the thermal element are obtainable to vary the amount of ink jetted in one dot. Another such ink jet printing head is described in U.S. Pat. No. 4,731,621 to Hayamizu et al.

Another type of print head is disclosed in U.S. Pat. No. 4,764,780 to Yamamori et al. in which an ink ejection recording apparatus includes a plurality of ink ejection heads connected to an ink tank. Each of the ink ejection heads have an ink nozzle through which minute ink droplets are discharged in accordance with an electric signal. An air nozzle opposing the ink nozzle and adapted for forming an air stream accelerates the ink droplets toward a recording medium.

A conventional airbrush is manufactured by the Paasche Airbrush Co. In Harwood Heights, Ill. The airbrush employs a reciprocating needle that retrieves paint from a reservoir and exposes the paint on the needle to a jet of air. The paint is blown from the needle and onto a print medium. Metering of the paint, however, is manually controlled by pressing a finger lever to allow air to flow through the airbrush.

Typical desk top ink jet printers for home or office use are relatively inexpensive but are usually limited to printing on standard office size sheets of paper, such as 8½×11 or similar standard sizes. Printers that can accommodate larger formats such as poster-sized sheets, however, are currently thousands of dollars to purchase. Printing machines that can print billboard-sized sheets are typically tens of thousands of dollars to purchase.

Some wide format printers are able to accommodate 16 feet or wider substrates, such as films, paper, vinyl, and the like, and can print 300 $ft^2$ per hour, depending on the resolution of the print. Such machines sometimes employ piezo printhead technology that employs several printheads per color with numerous nozzles per printhead to deposit ink onto the print medium. Another approach is to employ air brush technology in which inks are metered by valves and/or pumps and deposited onto the substrate. The quantity of ink pumped for each color and the position at which it is deposited on the print medium is typically computer controlled. The print medium is typically provided on a roll in which unmarked medium is fed under the print head and printed medium is re-rolled once the ink has had sufficient time to dry. Large format printers using air brush technology typically have a resolution of up to 70 dpi.

In addition to the cost of the machine itself, which employs relatively small orifices, valves and nozzles for depositing the desired quantity and color of ink on the print medium (e.g., paper), very fine grade inks are used in which particle sizes within the inks are kept to a minimum to help keep the orifices, valves, and nozzles of the ink system from becoming clogged. Such inks are expensive and are not very cost effective for painting or printing billboard sized images. Despite the high quality and expense of ink products, clogging of the printhead is still a problem in current printer technologies.

Many large format printers also use water-based inks that may not be suitable for outdoor use. Accordingly, special waterproofing systems and techniques must be employed, such as treating the printing medium with a substance that binds with the ink once deposited to form a waterproof mark or laminating the print with a weatherproof film. These weatherproofing techniques and processes add expense to the cost of each print.

Thus, it would be advantageous to provide a paint injector or print head employed in a digital printer that does not include orifices and/or nozzles through which the ink or paint must flow and, thus, is not limited by paint particle size or large particle contamination and is relatively insensitive to the physical properties of the paint. It would also be advantageous to provide a device that can utilize paints and inks already designed for the sign and art industries and that can be employed to digitally print on large format media.

SUMMARY OF THE INVENTION

It is an object of the present invention to provide a paint injector that can print with many forms of liquid printing materials such as paints and inks.

It is another object of the present invention to provide a paint injector that is relatively simple in construction and relatively inexpensive to manufacture.

It is yet another object of the present invention to provide a paint injector in which the liquid printing material is metered through computer control.

It is still another object of the present invention to provide a plurality of paint injectors in a print head, each paint injector containing a different color, and employing the print head to create a digital image on a print medium.

Accordingly, a paint injector is provided comprising an air nozzle that directs one or more jets of air across a moving member, the member having ink, paint, or other similarly pigmented liquid material disposed thereon. The air pulls the paint from the member and directs it onto a print medium, such as paper, vinyl, film, or other print media known in the art. Preferably, the member is an elongated segment of material that is advanced in front of the air jet or jets by at least one wheel around which the segment is at least partially disposed. Thus, as the segment is advanced in front of the air jet or jets, paint thereon is blown off of the segment and onto the print medium.

In a preferred embodiment, a single wire strand is employed to bring ink or paint contained within a reservoir in proximity with an air stream where it is carried to a print medium. A microprocessor or other controlling device controls the wire so that the speed of the wire's advance through the air stream meters the quantity of paint injected into the air stream. As the wire is advanced through the reservoir, a coating of paint clings to the wire, the thickness of the coating being controlled to a degree by the viscosity of the paint. In addition, a mechanical metering device, such as a scraper riding proximate to or in contact with the wire as it is advanced, may be employed to control the thickness or amount of paint on the wire before it enters the air stream. The wire, having a coating of paint thereon, is then drawn into close proximity to one or more jets of air. As the paint on the wire reaches the jet or jets of air, it is pulled or blown from the wire and into the air stream until it impacts the print medium. In order to keep the wire positioned in front of the air stream, a wire guide may be employed proximate to the air nozzle to prevent the wire from being forced away from the air stream and to reduce vibration of the wire in the air stream.

The wire is preferably drawn through the paint reservoir and thus coated with paint by being disposed at least partially around a pulley or wheel driven by a motor and at least partially around a rotatable or stationary idler or guide that is at least partially immersed in paint or other pigmented liquid material. A processor, controller, microprocessor, processor, or other computing device, controls the advance of the motor and thus movement of the wire. In addition, the processor controls movement of the paint injector or injectors as it is swept across a print medium. By utilizing a plurality of paint injectors in a print head, each containing a different color of paint, and by controlling and coordinating the metering of the paint and the position of the print head, as with error diffusion, stochastic screening, or blue noise algorithms as known in the art, a digital image can be created on the print medium.

DETAILED DESCRIPTION OF THE PREFERRED EMBODIMENTS OF THE PRESENT INVENTION

Figure 1A:
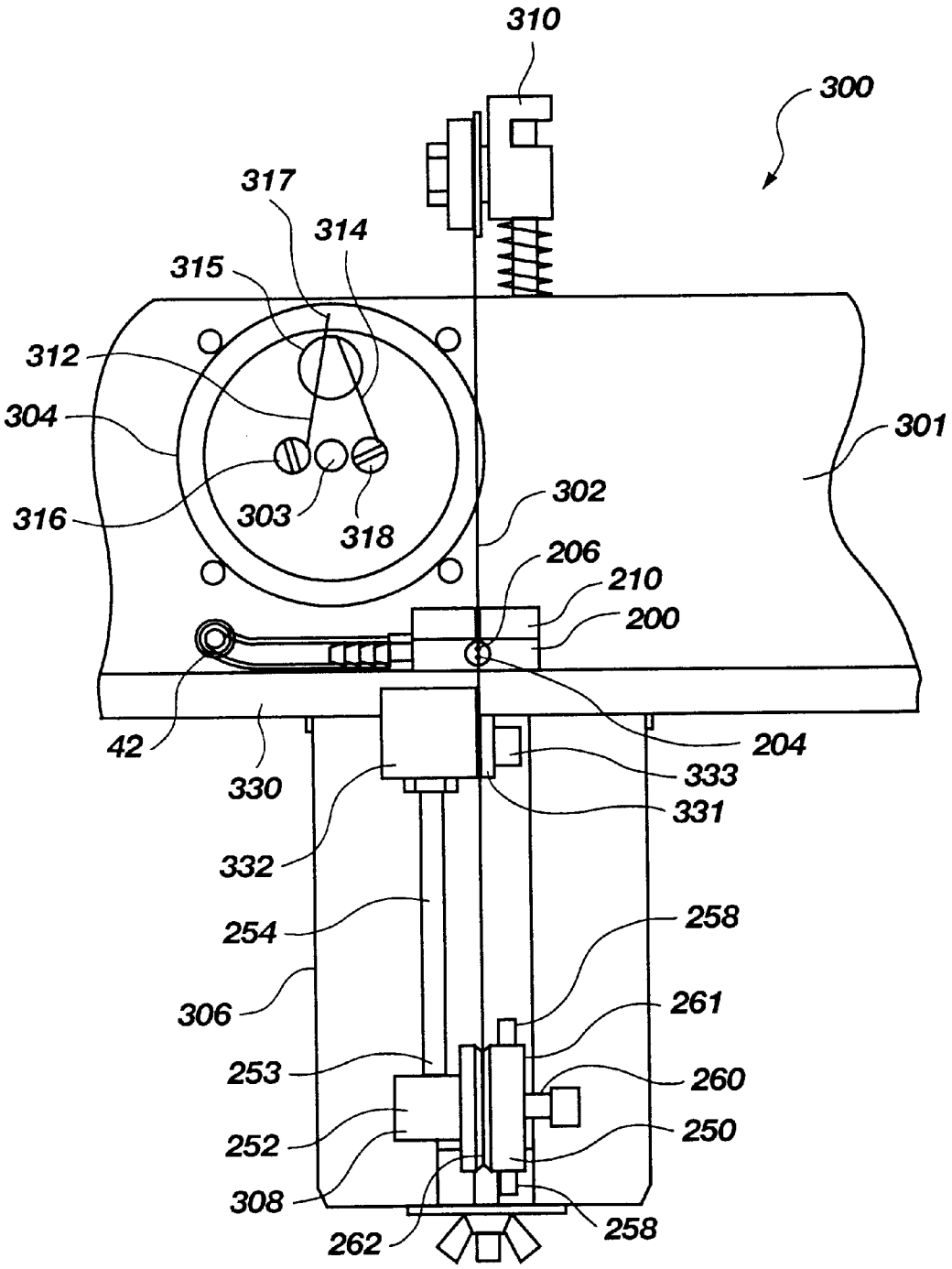
FIG. 1A is a front view of a first preferred embodiment of a paint injector in accordance with the present invention.

FIG. 1A illustrates a preferred embodiment of an single color paint injector, generally indicated at 300, in accordance with the present invention for selectively and controllably depositing paint, ink, dye, or other liquified pigmented material onto a print medium. The paint injector 300 is preferably attached to a frame or plate 301 shown in partial view to which a plurality of such paint injectors may be secured. The paint injector 300 comprises a segment of material such as a single strand of wire 302 (e.g., steel music wire, stainless steel, spring metal, nickel/titanium alloy, and/or other metals and alloys or of such materials as kevlar, graphite, nylon or other materials that are flexible and have a substantially high tensile strength), a wire hoop or loop as made from an endless cable or formed by photo etching techniques from flat sheet/shim stock, a band, a ribbon, or a relatively thin structure having material windable from a freely rotatable idler, spool or wheel onto a drive spool or wheel, or any other structure upon which liquified pigmented material could be applied. The wire 302 is drawn in front of a nozzle body 200, and more specifically, in the path of an air stream emanating from a pair of nozzle orifices 204 and 206 defined in the nozzle body 200.

An air supply hose 42 is secured to the nozzle body 200 and supplies air through the nozzle orifices 204 and 206. The nozzle orifices 204 and 206 are aimed at a segment of the wire 302 passing thereby. A wire guide 210 defining a longitudinal slot 212 is positioned proximate the nozzle orifice 204. The wire 302 rides within the slot 212 and is thus held in relative position to the nozzle orifices 204 and 206 so that air passing therethrough does not substantially move the wire 302 from in front of the nozzle orifices 204 and 206 or cause the wire 302 to substantially vibrate.

In this embodiment, the wire 302 is both advanced by and taken up by a single wheel 304. The wire 302 is fed from the wheel 304 into a container or paint reservoir 306, at least partially around a rotatable or stationary idler or guide 308, through the wire guide 210, at least partially around a rotatable or stationary wire biasing idler or guide 310, and rewound upon the wheel 304. The guide 308 is comprised of a substantially cylindrical wheel 250 rotatably attached to a base 252. The wheel 250 is rotatable upon the axil 260, in this embodiment formed from a #10-32 socket head screw comprised of teflon/delrin. Likewise, the guide 308 may comprise a non-cylindrical, non-rotatable member having a groove or slot therein in which the elongate segment of material, in this embodiment a wire 302, can slide upon rotation of the wheel 304. A plurality of projections or paddles 258 are attached to or formed integral with a shaft 260 attached to the wheel 250. These paddles 258 mix the paint contained in the reservoir 306 as the wheel 250 rotates by movement of the wire 302 through the circumferential groove 262. Those skilled in the art will appreciate that the paddles 258 may comprise fins or other protuberances or may be configured as slots or grooves in the surface 261 of the wheel 250 in order to create an irregular surface.

The guide 308 is maintained in position within the reservoir 306 by an elongate member 254 depending from a frame or plate 330. The elongate member 254 is secured to the plate 330 through a scraper attachment member 332. The guide 308 is secured to a distal end 253 of the elongate member 254.

The wire 302 is secured to the wheel 304 at both ends 312 and 314 as with threaded fasteners 316 and 318, respectively, or other means known in the art. The wire 302 passes through a larger aperture 315 to the other side of the wheel 304 and is wound onto the wheel 304 from the feed end 314 of the wire 302, around the various components of the injector 300, through a smaller aperture 317, and secured back to the wheel 304 at the take-up end 312. Preferably the wire 302 is comprised of a single strand having a diameter of approximately 0.005 to 0.006 inches in diameter, although wires of other dimensions may work equally as well, and is of a length that can be wrapped around the wheel 304 several times.

Figure 1B:
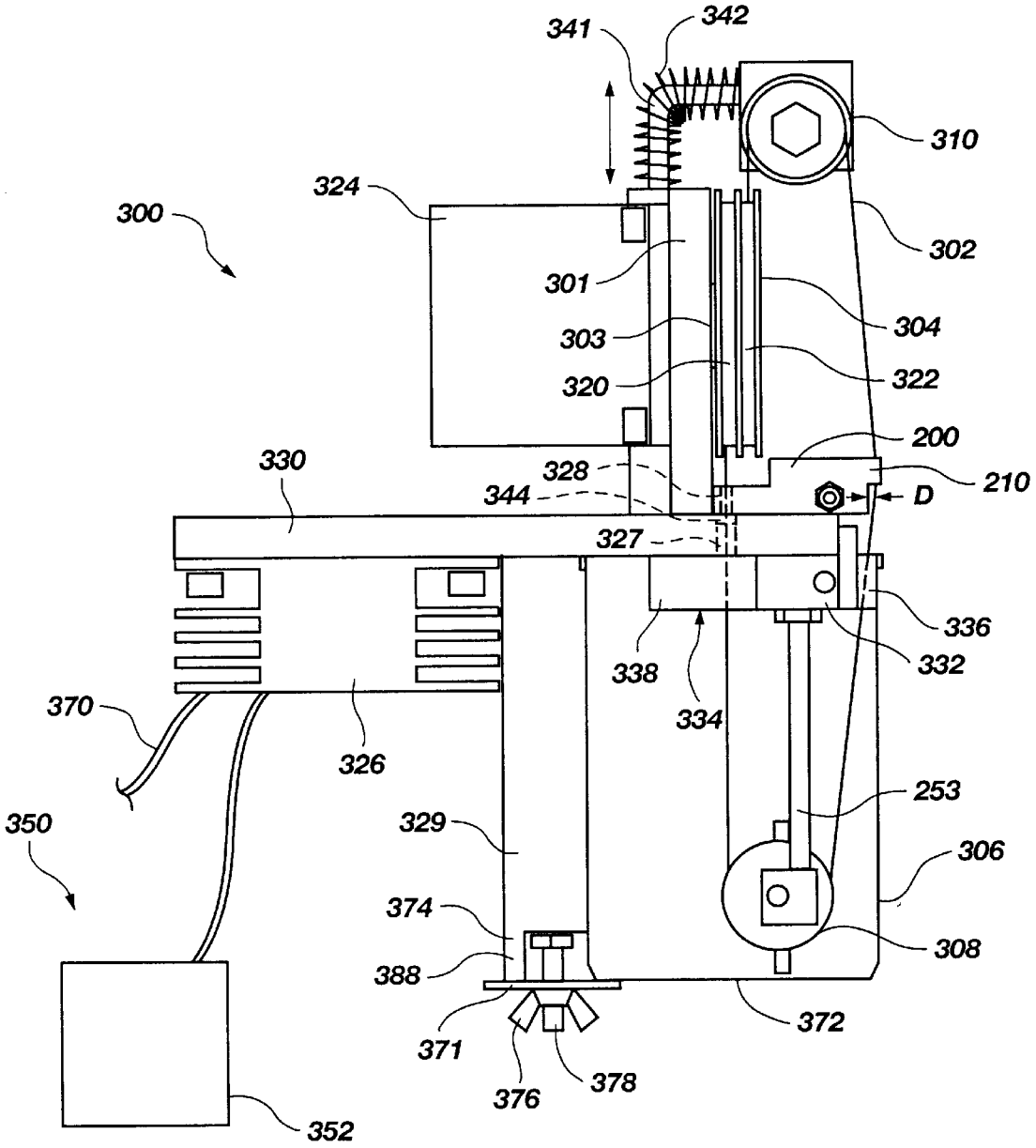
FIG. 1B is a side view of the paint injector illustrated in FIG. 1A.

As better seen in FIG. 1B, which shows a side view of the paint injector 300 of FIG. 1A, the wheel 304 defines two circumferential grooves 320 and 322. The first circumferential groove 320 defines the feed side of the wheel 304 while the groove 322 defines the take-up side. An electronically controllable drive mechanism, such as a motor 324, is employed to rotate the wheel 304 and thus advance the wire 302. The motor 324 may be a stepper motor, a DC motor, or other device known in the art in which rotational advancement of the wheel 304 can be selectively and/or incrementally controlled. The motor 324 is preferably electronically connected to and controlled by a processor or controller, generally indicated at 350, comprising an electronics module 326 and a signal generating device 352, such as a personal computer employing a microprocessor or other devices that can generate discrete signals to instruct selective rotation of the shaft 303 of the motor 324. The circuitry of the electronics module 326 receives one or more signals from the device 352 and rotates the shaft 303 of the motor according the signal(s). Those skilled in the art will recognize that such circuitry could be incorporated into the device 352 or that the components of the device 352 could be incorporated into the module 326. In the case where the motor 324 is a stepper motor, the signal(s) is sent in the form of one or more electrical pulses, each pulse designating a single step or a certain number of steps that the shaft 303 of the stepper motor 324 is to be rotated. A typical stepper motor provides 200 steps per revolution with each step being activated by a voltage in the range of 0.2 to 5 volts, depending on the voltage requirement of the motor. Thus, if it is desired to deposit the quantity of paint drawn by the wire 302 in one half of a revolution of the wheel 304, 100 pulses would be sent by the device 352, the module 326 would convert each pulse into a voltage depending on the voltage requirement of the stepper motor 304 sufficient to cause the stepper motor 324 to rotate its shaft 303 one step, and the shaft 303 would rotate 100 steps. A power supply line 370 may be connected to the module 326 to provide the requisite voltage to turn the shaft 303 of the motor 324. A preferred way of driving the motor 324 is to perform all shaft 303 advances for the paint injector 300 by time calculations made by the device 352 thereby eliminating the need for a calculating device within the paint injector 300 itself. Such time calculations may employ error diffusion, stochastic screening, or blue noise algorithms as are known in the art. Thus, all wire 302 advances for the same color of paint, in addition to spatial motions of the paint injector 300 relative to the print medium for depositing the metered paint at relatively precise locations, can be made by the device 352 driving logic lines connected to the module 326 driving the motor 324. If a DC servo motor is employed, the signal sent from the device 352 would be converted into a voltage by the module 326 necessary to rotate the shaft 303 of the DC motor a desired portion of a rotation, and a feedback device, such as an optical encoder, would be employed by the module 326 to control the precise rotation. It is also contemplated that a crude metering of paint could be accomplished by simply providing a timed duration of power to a motor without feedback.

When the motor 324 is activated to advance the wire 302 by electronics 326, the wire passes through a first bore or slit 328 extending through the nozzle body 200, through a second bore 327 defined in and extending through a frame or plate 330. The plate 330 is employed to support the electronics 326, elongated support member 329 that supports the reservoir 306, and a scraper attachment member 332. The reservoir is maintained in position relative to the elongated support member 329 by a small plate 371 abutting the bottom surface 372 of the reservoir 306. The small plate 371 is secured to the distal end 374 of the elongated support member 329 with an internally threaded fastener 376 which is threaded onto an externally threaded shaft 378 secured to the distal end 374 of the elongated support member 329. In addition, the elongated support member 329 includes a flange 388 depending from the distal end 374 such that the fastener 376 biases the small plate 371 against the surface 374 of the reservoir 306. Other configurations of reservoirs and containers and means of attaching such containers relative to the plate 330 are also contemplated without departing from the spirit of the present invention. In addition, it is also contemplated that a reservoir may not be required if the pigmented material being deposited is dribbled or otherwise applied, as by wiping across a paint soaked pad, to the wire 302. A scraper attachment member 332 provides both a foundation for attachment of the elongated support member 253, to which the idler or guide 308 is attached, and a scraper device 334 comprised of a pair of elongated plates, only one 336 of which is visible.

Figure 2:
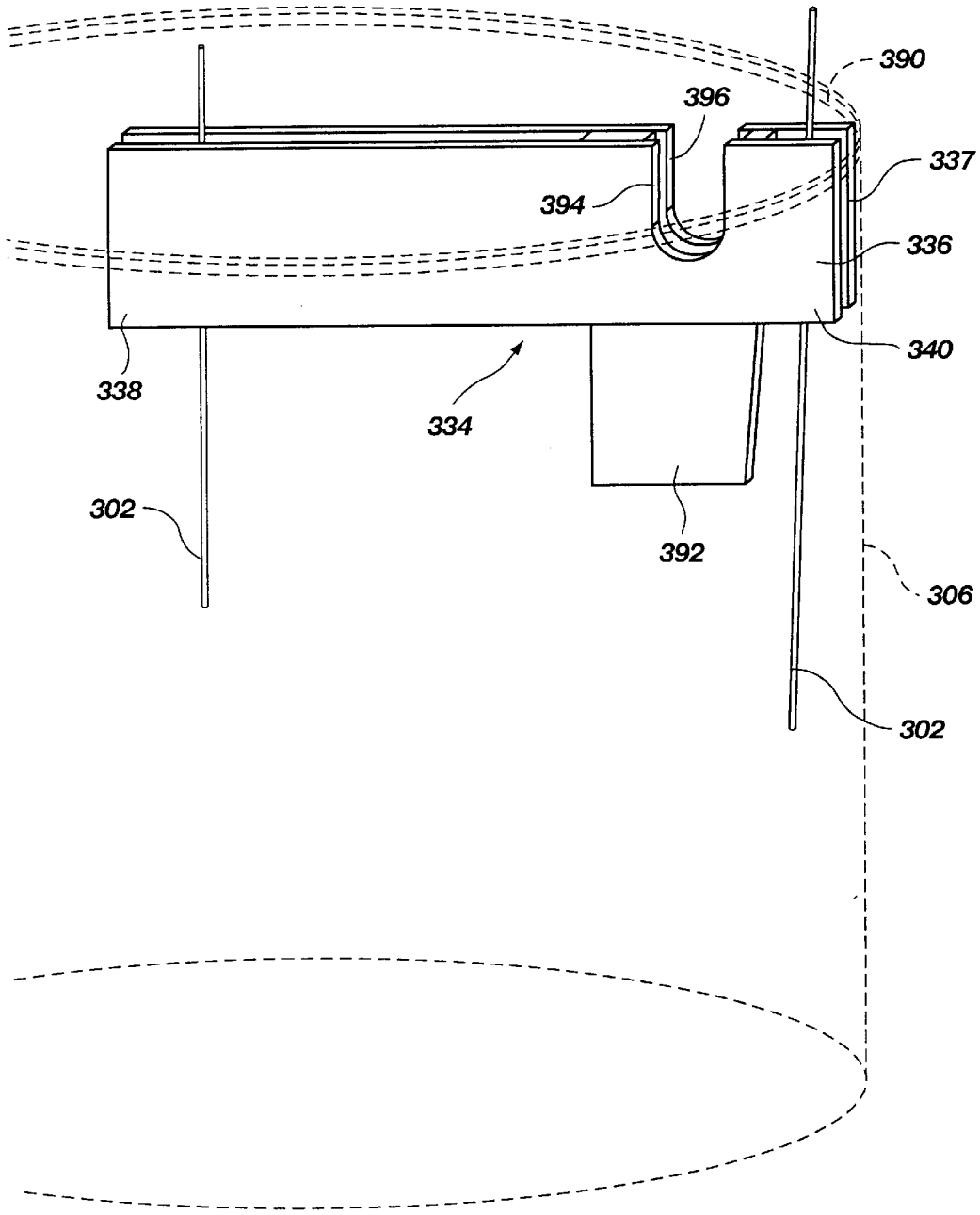
FIG. 2 is a perspective side view of a scraping device in accordance with the present invention.

As better shown in FIG. 2, the elongate plates 336 and 337 are maintained in substantially parallel relationship proximate to the top edge 390 of the reservoir 306, represented by dashed lines. The plates 336 and 337 are each provided with a slot 394 and 396 for securement to the scraper attachment member 332 illustrated in FIGS. 1A and 1B. As shown in FIGS. 1A and 1B, the scraper attachment member 332 is preferably comprised of a block attached to the plate 330. The plates 336 and 337 are secured to the block 332 by a small plate 331, which spreads the clamping force across the plates 336 and 337 and a screw 333, such as a 10-32 socket head screw, which passes through the slots 394 and 396 securing the plates 331, 336, and 337 to the block 332. Preferably the plates 336 and 337 are comprised of metal, such as spring steel, having a thickness of approximately 0.013 inches. The wire 302 passes between the plates 336 and 337 of the scraper device 334 proximate a first end 338, is fed around the idler or guide 308 (see FIG. 1B) and through the scraper device 334 a second time proximate a second end 340 thereof. The passage of the wire 302 through the scraper device 334 at the second end 340 wipes a substantial amount of paint from the wire 302 and provides a uniform coating of paint on the wire 302. The thickness of the paint remaining on the wire 302 may be adjusted by providing a spacer 392 between the plates 336 and 337 of the scraper device 334. For example, the spacer 392 could be provided having a thickness of 0.006 inches at the clamped point between the plates 336 and 337 to accommodate a wire 302 having a diameter of 0.006 inches in order to limit wear of the wire 302 but substantially control the amount of paint retained by the wire 302 after passage through the scraper 334. The paint wiped from the wire 302 by the scraper device 334 will accumulate on the scraper device 334 and drip back into the reservoir 306. The remaining paint will be removed from the wire 302 by the air jets passing through the nozzle orifices.

Referring again to FIG. 1B, the wire 302 passes in front of the nozzle body 200 and is held relative thereto by the wire guide 210. As illustrated, the wire guide 210 holds the wire a desired distance D, such as about 0.040 inches, from the nozzle body 200 and thus the nozzle orifices (not visible). In addition, the wire guide 210, in conjunction with the biased wire guide 310 keeps tension on the wire 302 in front of the nozzle orifices by imparting a bend to the wire at the wire guide 210 and thus holds the wire in relative position to the nozzle orifices.

By providing a rotatable wire biasing guide 310, wire tension on both sides of the biasing guide 310 may be maintained on the wire 302 as the wire 302 is unwound and rewound onto the wheel 304. This may prevent the wire 302 from pulling down unequally on the spring 342 and the wire from jumping out of the biasing guide 310. The biasing guide 310 is important because the length of the wire 302 extending between the groove 320 and the groove 322 will vary as the wire 302 is wound and unwound between the two grooves 320 and 322. The guide 310 is secured to an elongated guide support member 341 formed into a ninety-degree elbow configuration. As such, the guide 310 is positioned to feed the wire 302 to near the center of the groove 322. Of course, the guide 310 may be positioned at other points along the path of the wire 302 in order to maintain tension on the wire 302. The support member 341 is secured to the frame or plate 301 in a manner that allows the support member 341 to move (e.g., slide) in directions indicated by the arrow. A biasing device 342, such as a coil spring positioned around the support member 341, is employed to bias the guide 310 away from the wheel 304. Accordingly, depending on the spring force of the biasing device 342, a desired tension can be maintained in the wire 302 during operation of the injector 300. Those skilled in the art will understand that other biasing devices or members and support structures may be employed to maintain tension in the wire 302 during the course of operation of the device.

Of course, only a limited amount of wire 302 can necessarily be wound onto the wheel 304. While it may be possible to provide enough wire 302 that one pass of the wire from the groove 320 to the groove 322 is sufficient to complete an entire printing application, it is more likely the case, especially for a print job of any substantial extent, that the wire 302 will be required to be rewound into the groove 320 during the course of printing. It is preferred that the wire 302 be rewound after each pass of the injector 300 over the print medium. In a rewind cycle, the scraper device 334 provides secondary wiping of the wire 302 as it passes through the scraper device 334 and onto the wheel 304 in groove 320. It is noted that while the scraper device 334 which provides both wiping of the wire 302 when the wire is being advanced and wiping of the wire 302 when it is being rewound could be comprised of two separate scraping devices. The secondary wiping of the wire is obviously important because the wire 302 is recoated with paint as it is drawn through the paint reservoir 306. The bore 328 provides a wire guide to align the wire 302 with the groove 320. In addition, it is preferable that the bore 328 be of a smaller size than the bore 327 such that a wiping device 344 be provided around the wire 302 in the bore 327. Preferably the wiping device 344 is comprised of a string of material, such as dental floss, tied in a knot around the wire 302 that is of a size that it cannot pass through the bore 328 or through the scraper device 334. Preferably, such a knot is formed by wrapping the string of material three or four times around the wire 302 and tying the ends tightly together. Of course, those skilled in the art will recognize that other wiping devices could be employed, such as sponges and other fabrics and materials that can substantially wipe any remaining paint from the wire 302. The wiper device 344 substantially removes the remaining paint from the wire 302 as it is rewound into the groove 320 in order to keep groove 320 substantially free of paint.

As shown in FIG. 1A, in operation, paint or other pigmented liquid material contained in the container 306 is picked up by the wire 302 and advanced by rotation of the wheel 304, indicated by the arrow, in front of the nozzle orifices 204 and 206. In order to help control the speed of rotation of the wheel 304, a series of gears, wheels, belts, or combinations thereof may be employed between the shaft 303 of the motor (see FIG. 1B) and the wheel 304. Air being blown through the nozzle orifices 204 and 206 disperses or pulls paint from the wire 302 toward the painting surface. Depending on the viscosity of the paint, the cross-sectional diameter of the wire 302, the use of a mechanical scraping device, and the diameter of the wheel 304 formed by the groove in which the wire 302 resides, a relatively precise amount of paint can be effectively metered by relatively precisely rotating the shaft 303. Such an apparatus may produce images having a resolution of approximately 100 dpi or better, which is more than adequate for larger format prints such as poster-size, billboard-size, and the like. The force of the air stream upon the wire 302 removes the remaining quantity of paint on the wire 302 in such a manner as to produce a relatively clean wire 302 for engagement with the wheel 304. Thus, the wire 302 can be wound upon the wheel 304 without the wheel 304 becoming filled or otherwise obstructed with paint. While an air stream has been described as the preferred vehicle for transporting the paint from the wire 302 to a print medium, it is also contemplated that other fluid streams, such as thinner or other materials known in the art, may be employed or mixed with air or another gas to transport the paint from the wire 302 to a print medium.

Figure 3A:
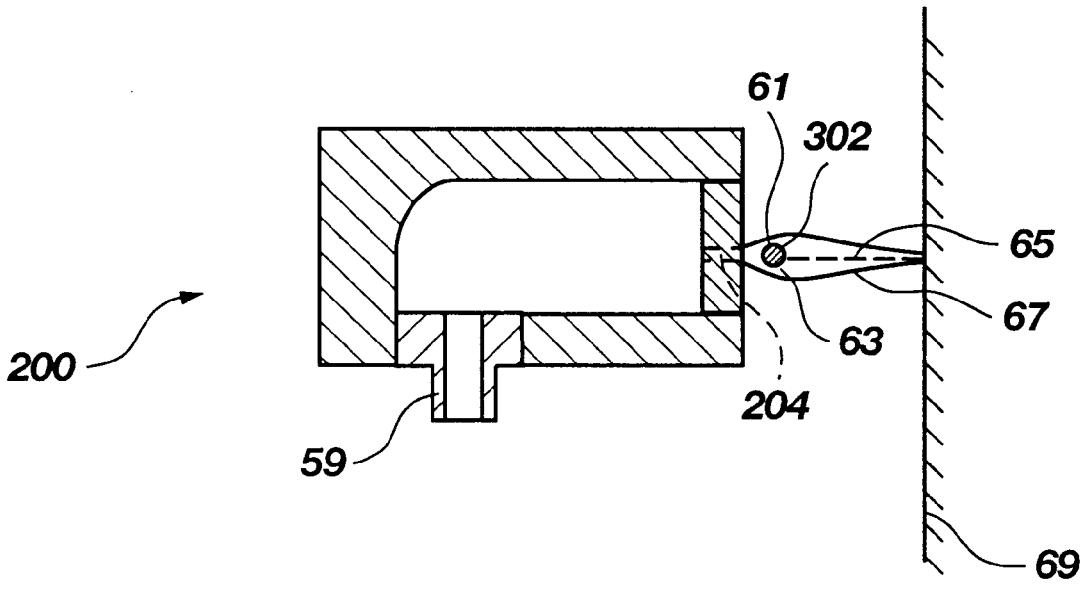
FIG. 3A is a cross-sectional top view of a nozzle body in accordance with the present invention.

The nozzle body 200 is shown in cross-section in FIG. 3A and includes an air supply connector 59 and two orifices 204 and 206, only one of which is visible, that produce low pressure zones 61 and 63 on both sides of the wire 302 and thus draw the paint 65 from the wire 302 into the air stream 67. The low pressure zones 61 and 63 also help keep the wire 302 centrally located in front of the nozzle orifices 204 and 206 by providing substantially equal pressure on both sides of the wire 302. Preferably, the orifices 204 and 206 each have a diameter of approximately 0.014 inches and a length of 0.050 inches. While a two nozzle configuration has been illustrated, various other nozzle configurations may be equally effective for removing the paint 65 from the wire 302 while reducing spray or divergence of the paint within the air stream 67 and are thus contemplated within the scope of the present invention.

Spatter created by the paint 65 impacting the print medium 69 and by turbulent flow of air around the wire 302 may be controlled by controlling the pressure of air supplied to the orifices 204 and 206, and thus the velocity of the air stream 67. For orifices 204 and 206 as described, an air pressure of approximately 10 psi would be sufficient to direct the paint 65 toward the print medium 69 and substantially clean the wire 302 while minimizing spatter. Higher pressures of 80 psi or more may have equal utility depending on the distance of the wire 302 from the print medium 69, the quantity of paint 65 on the wire 302, and the diameter of the orifices 204 and 206.

Figure 3B:
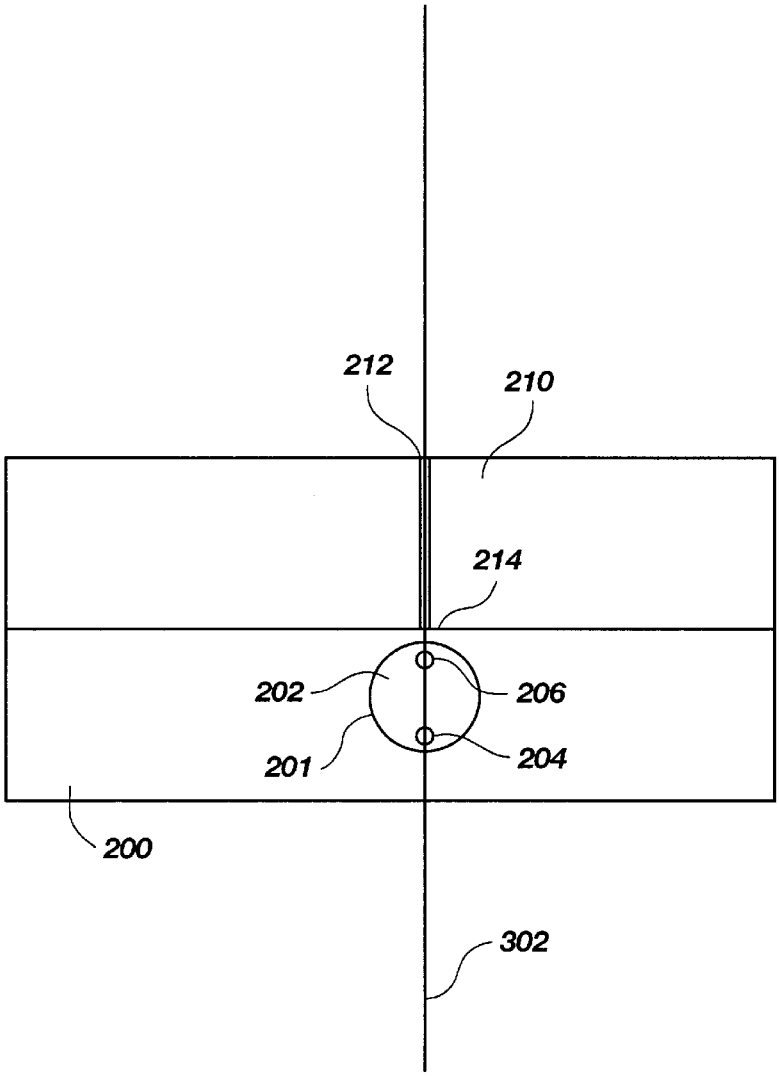
FIGS. 3B–3F are front views of five preferred embodiments of nozzle orifice configurations in accordance with the present invention.
Figure 3F:
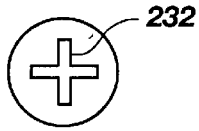
Figure 3C:
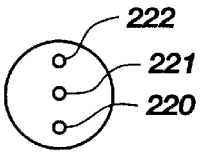
Figure 3D:
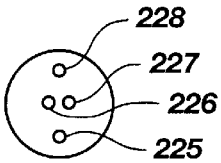
Figure 3E:
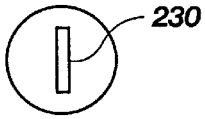

FIG. 3B illustrates a front view of the nozzle body 200 which has a substantially cylindrical nozzle insert 202 secured within an opening 201 thereof. The nozzle insert 202 defines the two orifices 204 and 206 therein oriented in substantial alignment with the wire 302. Of course, the two orifices 204 and 206 may be integrally formed with the nozzle body 200. A wire guide 210 is secured to or integrally formed with the nozzle body 200 and defines an elongated slot 212 therein having a length sufficient to guide and stabilize the wire 302 in front of the nozzle orifices 204 and 206. As paint or other pigmented liquid material is drawn in front of the nozzle insert 202, air flowing through the first nozzle orifice 204 removes a substantial amount of paint or pigmented liquid material that has been applied to the wire 302 and disperses the paint onto a print medium. The second nozzle orifice 206 removes substantially all of the remaining paint or pigmented liquid material from the wire 302. Utilizing such a nozzle orifice configuration has been discovered to be important in reducing the amount of splatter that can occur after some period of painting. Paint that would otherwise remain on the wire 208 after passing through the air stream of the nozzle orifice 204 or that is blown upwardly onto the wire guide 210, may accumulate on the lower edge 214 of the wire guide 210. If a sufficient amount of paint or pigmented liquid material is present on the lower edge 214 to form a droplet, the droplet will eventually fall into or be drawn into the air stream depositing a splatter of paint onto the print medium. By providing the second nozzle orifice 206 to remove any remaining paint from the wire 208 and to capture paint directed in an upward direction from the first nozzle orifice 204 that may otherwise be deposited on the wire guide 210, an accumulation of paint does not occur on the lower edge 214 and splattering is substantially reduced and/or prevented, increasing the quality and resolution of the print. Of course more nozzle orifices could be provided, such as three orifices 220, 221, and 222 as illustrated in FIG. 3C, four orifices 225, 226, 227, and 228 as depicted in FIG. 3D to provide efficient paint removal and stabilization of the wire, a single elongated slot orifice 230 as shown in FIG. 3E, or a single cross-shaped orifice 232 as illustrated in FIG. 3F.

Figure 4:
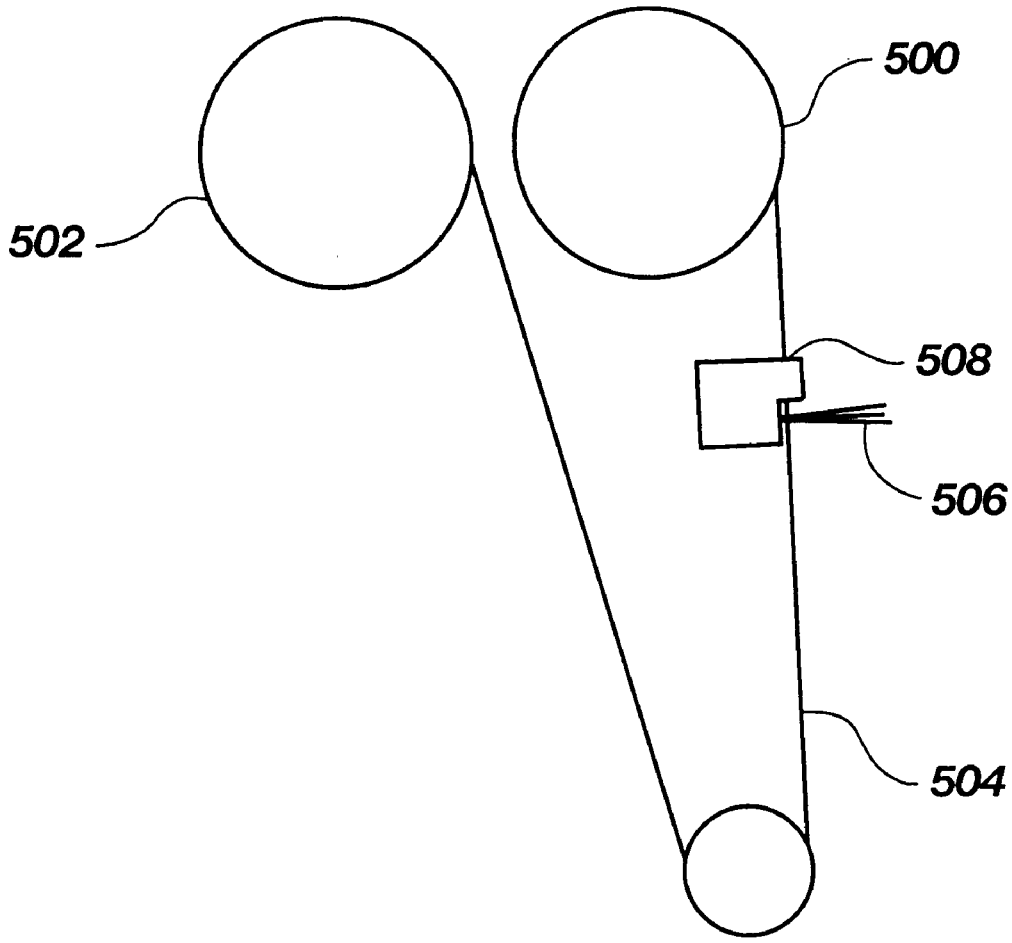
FIG. 4 is a schematic side view of a second embodiment of a paint injector in accordance with the present invention.

While, as previously discussed, a single wheel may be employed to advance and take-up the wire, as schematically illustrated in FIG. 4, it is equally plausible that two wheels 500 and 502 may be employed to advance the wire 504 in front of an air stream 506 emanating from a nozzle body 508. Accordingly, the wheel 500 could advance the wire 504 during the printing sequence and the wheel 502 could rewind the wire at the end of each printing cycle.

Figure 5:
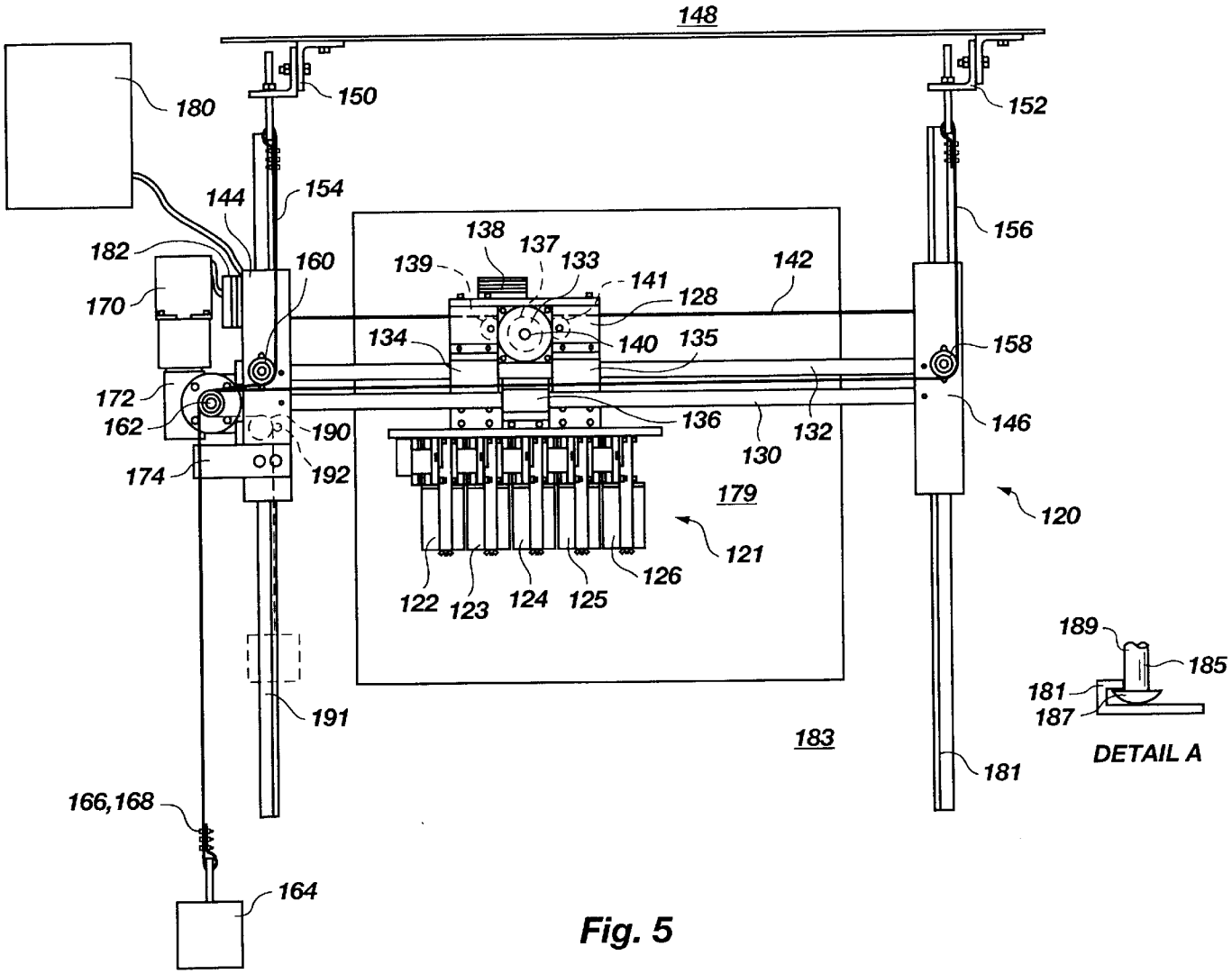
FIG. 5 is a back view of a printing device employing a print head having a plurality of paint injectors in accordance with the present invention.

Referring now to FIG. 5, a digital printing device 120 employing a plurality of paint injectors, in this example five (5) paint injectors 122, 123, 124, 125, and 126, such as the paint injectors herein described, is attached to a moveable carriage 128. Each paint injector 122, 123, 124, 125, and 126 contains a different color of paint comprising a multi-color print head 121. Of course, more or less paint injectors may be employed depending on the needs of the user. For example, paint injector 122 may contain yellow, paint injector 123 may contain magenta, paint injector 124 may contain cyan, paint injector 125 may contain black, and paint injector 126 may contain white. Because the print medium is typically white, white paint is not used as a standard color in conventional printheads. Standard process colors include yellow, magenta, cyan, and black. Having white paint added to the mix of colors, however, allows a graphics artist to manually add detail to a wet print without "mudding" the colors or the image. It is also contemplated that more or fewer paint injectors may be included with various colors contained therein depending on the desired colors of print to be produced.

To selectively move the carriage 128 in an x-direction, the carriage 128 is mounted on a pair of shafts 130 and 132, preferably 1 inch round shafts, with linear bearings 134, 135, and 136 that allow the carriage 128 to relatively easily slide along the shafts 130 and 132. A motor 133, such as a stepper motor, controlled by x-drive electronics 138 and having a sprocket 137 attached to the shaft 140 thereof is employed to move the carriage 128 along the shafts 130 and 132. The sprocket 137, in conjunction with freely rotatable sprockets or idlers 139 and 141, engages with the drive chain 142 (shown in dashed lines) to move the carriage 128 along the shafts 130 and 132. The drive chain 142 as well as the shafts 130 and 132 are fixed between a left support assembly 144 and a right support assembly 146. It is also contemplated that the motor 133 be mounted on either the left assembly 144 or right assembly 146 or some other structure to lower the mass of the carriage 128. Such a motor would then drive a moveable chain or belt to position the carriage 128 at the desired location.

To selectively move the carriage 128 in a z-direction, the entire printing device 120 is mounted to an overhead structure such as a ceiling 148 with bracket assemblies 150 and 152. The left bracket assembly 150 supports a pair of left z-drive roller chains 154 (only the closest of which is visible) and the right bracket assembly 152 supports a pair of right z-drive roller chains 156 (only the closest of which is visible). A freely rotatable sprocket 158 is mounted to the right assembly 146 and engages one of the right z-drive roller chains 156. Similarly, on the opposite side of the right assembly 146, another freely rotatable sprocket mounted to the right assembly 146 engages the other of the z-drive roller chains 156. Likewise, a freely rotatable sprocket 160 is mounted to the left assembly 144 and engages one of the left z-drive roller chains 154 and another freely rotatable sprocket on the opposite side of the left assembly 144 engages the other of the left z-drive roller chains 154. Both the left z-drive roller chains 154 and the right z-drive roller chains 156 engage with z-drive sprockets 162 (four in all, only the closest of which is visible) and have weights 164, (four in all, only the closest of which is visible) suspended from their distal ends 166 and 168, respectively, to keep the chains 154 and 156 taut around the sprockets 162. Similar to the x-drive assembly, the sprockets 162 are driven by a motor 170, such as a stepper motor, that engages with a worm gear unit 172 as is known in the art to transfer rotational movement of the motor 170 to the sprockets 162 and thus move the left and right assemblies 144 and 146 and thus the carriage 128 in a z-direction. Chain guards, such as chain guard 174, may be utilized near the sprockets 162 to maintain engagement of the chains 154 and 156 with the sprockets 162. Likewise, as illustrated by dashed lines, other freely rotatable sprockets 190 may be employed to direct the chains 154 and 156 around a larger portion of the sprockets 162 and thus prevent the chains 154 and 156 from skipping or falling from the sprockets 162. A retaining rod 192 may also be employed to help maintain the chains 154 and 156 in engaging contact with the freely rotatable sprockets 190.

In order to keep the print head 121 from swaying either away from a print medium 179 or from side to side, a track 181 may be vertically oriented and secured to the structure 183, such as a wall or frame, to which the print medium 179 is temporarily secured. As shown in DETAIL A, the track 181 has a J-shaped cross-section into which a guide member 185 can engage and slide therethrough. In this preferred embodiment, the guide member 185 is comprised of a threaded bolt having its head 187 retained by the track 181 and its shaft 189 secured to the right assembly 146. Accordingly, movement of the right assembly 146 is restricted from moving away from the print medium 179 or toward the left assembly 144. Similarly, a second track 191, having an opposite orientation to the track 181, is secured to the structure 183 to restrict movement of the left assembly 144 from moving away from the print medium 179 or toward the right assembly 146. Those skilled in the art will recognize that other track and guide member assemblies could be employed to maintain the printing device 120 in position relative to the print medium 179, such as a single C-shaped track and retaining member arrangement.

In operation, the print medium 179 is positioned in front of the digital painting device 120 and a controller 180, such as a computer, sends signals to the painting device 120 to direct movement of the print head 121 and dispersion of paint from the paint injectors 122, 123, 124, 125, and 126 to form an image on the print medium 179. More specifically, signals from the controller 180 are sent to the z-drive electronics 182 which in turn convert the signals into movement of the sprocket 162 along the chains 154 and 156 corresponding to the desired z-direction position of the print head 121. Likewise, signals from the controller 180 are sent to the x-drive electronics 138 corresponding to the desired x-direction position of the print head 121 along the shafts 130 and 132. The controller 180 also individually controls each of the paint injectors 122, 123, 124, 125, and 126 to deposit the desired color of paint on the print medium 179 at the desired location. Thus, the printable image size of the printing device 120 is only limited by the length of the chains 154, 156, and 142 and the length of the shafts 130 and 132.

The present invention also contemplates that the print head 121, or individual paint injectors 122, 123, 124, 125, and 126 could be employed with other digital printing devices known in the art for digital painting purposes. For example, the print head 121 could be employed in a device where movement of the print head is along an x-axis while a roll of print medium, such as vinyl, is selectively advanced relative to the print head 121 to affect movement along the y- or z-axis. With such a device, the size of print medium may only be limited by the size of the roll of print medium. Likewise, a rigid frame to which the print head, according to the present invention, can be mounted and upon which the print head could be selectively moved could also be employed to allow z- and x-direction movement or x- and y-direction movement of the print head, depending on the orientation of the frame.

It is also contemplated that a digital printer, such as the digital painting device 120 illustrated in FIG. 5, may be comprised of a single paint injector. Such a machine may be employed to create both monochromatic and multiple color prints. For example, full color prints may be generated by printing each process color individually with a single injector. Accordingly, the injector could print the full image for a particular color separation (e.g. cyan). The injector would then, preferably, be cleaned and filled with another color (e.g. black). The processing device would be instructed as to which color is present in the injector, and the full image for that color separation would be printed. The process would be repeated for each of the other necessary or desired colors (e.g., white, magenta, and yellow) until the image is complete. Such a single injector device would be less expensive to manufacture as requiring fewer injectors to manufacture and would produce the same or comparable quality of prints.

In general, the invention comprises digitally controlling the immersion of an extracting device into paint and the advancement of the once immersed and now coated extracting device in front of a stream of air to remove the paint from the extracting device and deposit it onto a print medium. It is noted that while references are made to paint in the specification and claims, the term is intended to encompass inks, dyes, and any other liquid pigmented material that can be deposited on a surface for printing or painting purposes. Moreover, references to the term "wire" in the specification and claims is intended to encompass a cord, strand, thread, string, ribbon, filament, cable, line, band, belt, strap, or any other elongated segment of material whether in a loop or not and whether in a flexible, resilient, stretchable, or more rigid form. In addition, it is to be understood that the above-described embodiments are only illustrative of the application of the principles of the present invention. Numerous modifications and alternatives may be devised by those skilled in the art, including combinations of the various embodiments, without departing from the spirit and scope of the present invention. The appended claims are intended to cover such modifications, alternative arrangements, and combinations.

What is claimed is:

1. A method of digital printing, comprising:

providing at least one paint injector having a strand;

applying a coating of paint to an exterior surface of at least a portion of said strand;

selectively advancing said strand into a path of said fluid stream; and directing a fluid stream at the paint coated portion of said strand to flow around said strand thereby removing paint primarily from an exterior surface of said strand and depositing it onto the surface of a print medium.

2. The method of claim 1, further including providing said at least one paint injector with a wheel rotatable by a shaft of a motor and an idler at least partially disposed in paint contained in a reservoir, said strand comprising a wire disposed at least partially around said wheel and said idler.

3. The method of claim 2, further including selectively advancing said wire through said path of said fluid stream for a select interval and then rewinding said wire onto said wheel.

4. The method of claim 3, further including mechanically metering the paint disposed on said wire before advancing said wire through said fluid stream.

5. The method of claim 4, further including wiping paint disposed on said wire before rewinding said wire onto said wheel.

6. The method of claim 1, wherein said directing a fluid stream comprises directing at least two jets of air toward at least two distinct points of said strand for removing paint from an exterior surface of said strand and for and reducing divergence of the paint within said fluid stream.

7. The method of claim 1, further including controlling a position of said at least one paint injector relative to a print medium to produce a printed image thereon.

8. The method of claim 7, wherein said controlling includes moving said at least one paint injector in an x and y direction relative to the print medium.

9. The method of claim 1, further including providing a plurality of paint injectors in a single carriage and providing each of said plurality of paint injectors with a different color of paint.

10. The method of claim 1, further including metering a layer of said paint on at least one side of an exterior surface of said advanceable structure, removing said layer from said exterior surface, and depositing the paint contained in said layer onto the print medium.

11. The method of claim 1, further including advancing said strand through a liquid reservoir before passing through said fluid stream.

12. The method of claim 1, further including generating said fluid stream from at least two nozzles, each nozzle directing a fluid stream around the sides of said strand.

13. The method of claim 1, wherein said directing said fluid stream includes producing a substantially continuous flow of air through at least one nozzle aimed at said strand for flowing around more than one side of said strand to remove paint from said more than one side of said advanceable structure.

14. A method for digital printing, comprising:

providing a print medium;

providing an air stream;

depositing a pigmented liquid onto the sides of an elongate segment;

directing said air stream around the sides of said elongate segment;

advancing said elongate segment though said air stream to remove said pigmented liquid from the sides of said elongate segment and to deposit said pigmented liquid onto said print medium at an electronically controlled location.

15. The method of claim 14, further including electronically controlling the position of the air stream and the elongate segment relative to the print medium.

16. The method of claim 14, wherein said electronically controlling includes moving said air stream and said elongate segment in an x and y direction relative to the print medium.

17. The method of claim 14, wherein said depositing includes applying a coating of pigmented liquid to the exterior of said elongate segment.

18. The method of claim 14, further including providing a plurality of air streams and a plurality of elongate segments.

19. The method of claim 18, further including providing a different color of pigmented liquid to each of said plurality of air streams and each of said plurality of elongate segments.

20. The method of claim 14, further including metering a layer of said pigmented liquid on at least a portion of said exterior surface of said elongate segment, removing said layer from said exterior surface, and depositing the pigmented liquid contained in said layer onto the print medium.

21. The method of claim 14, further including generating said fluid stream from a plurality of nozzles and directing said fluid stream around the sides of said elongate segment.

22. A method of producing an image on a print medium, comprising:

applying a pigmented liquid to an exterior of a strand;

advancing said strand through an air stream for removing an amount of said pigmented liquid from said exterior of said strand and depositing said amount onto the print medium;

electronically controlling said amount removed from said strand; and selectively positioning said air stream relative to the print medium for depositing said amount of said liquid proximate the position.

23. The method of claim 22, wherein said electronically controlling includes controlling advancement of said strand relative to said air stream.

24. The method of claim 22, further including providing a plurality of strands.

25. The method of claim 24, further including providing a different color of pigmented liquid for each of said plurality of strands.

26. The method of claim 22, further including metering a relatively thin layer of said pigmented liquid on at least on an exterior surface of said strand, passing said air stream around said strand for removing said relatively thin layer from said strand, and depositing the liquid contained in said relatively thin layer onto the print medium.

* * * * *